US005950517A

United States Patent [19]

Yoder

[11] Patent Number: 5,950,517

[45] **Date of Patent: *Sep. 14, 1999**

[54] SAWMILL CARRIAGE LOG TURNER

[76] Inventor: Daniel Yoder, 1300 Old Railroad La., Gutherie, Ky. 42234

[ * ] Notice: This patent issued on a continued prosecution application filed under 37 CFR 1.53(d), and is subject to the twenty year patent term provisions of 35 U.S.C. 154(a)(2).

[21] Appl. No.: 08/863,957

[22] Filed: May 27, 1997

[51] Int. Cl.[6] ..... B27B 29/02

[52] U.S. Cl. ..... 83/708; 83/35; 83/418; 83/435.11; 83/712; 144/250.24; 414/746.3

[58] Field of Search ..... 83/35, 418, 423, 83/435.11, 437.1, 708, 711, 712, 788; 144/250.24, 250.25; 269/13, 14, 54.2, 58; 414/746.3

[56] References Cited

U.S. PATENT DOCUMENTS 1,590,107 1/1926 Martin .
2,633,879 4/1953 Andrus .
3,071,170 1/1963 Pease et al. .
3,566,933 3/1971 Pryor ..... 143/125
3,603,362 9/1971 Nelld ..... 143/105
3,782,711 1/1974 Montgomery ..... 269/31
3,797,349 3/1974 Smith ..... 83/404.1

*Primary Examiner*—Lee W. Young
*Assistant Examiner*—Kevin G. Vereene
*Attorney, Agent, or Firm*—Theresa Camoriano

[57] ABSTRACT

This invention attaches to a sawmill carriage, enabling an operator to turn a log carried by the sawmill carriage without having to return the sawmill carriage to a fixed location. The invention includes a log turning hook with positioning guide bar that slides vertically with respect to, and pivots with, a cylinder. As the turning hook with positioning guide bar is lifting the log, the weight of the log is forcing the hook with positioning guide bar to pivot, which rotates the log ninety degrees into position for the next saw cut.

5 Claims, 6 Drawing Sheets

SAWMILL CARRIAGE LOG TURNER

CROSS REFERENCES TO RELATED APPLICATIONS

Not applicable.

Statement as to Rights to inventions made under Federally sponsored research and development: Not applicable.

BACKGROUND OF THE INVENTION

1) Field of the Invention

The present invention is a device mounted on a sawmill carriage that enables an operator to turn a log carried by the sawmill carriage.

2) Background Information

Sawmills turn a log carried by a sawmill carriage by a log turner that is at a fixed location, apart from the sawmill carriage itself. This means an operator must return the sawmill carriage to the log turner to turn the log. Loading and turning logs on the sawmill carriage is done at one end of the sawmill, with the sawmill carriage transporting the log to the other end of the sawmill, where a stationary saw is cutting the log into boards as the sawmill carriage moves the log past the blade. To optimize the amount of usable boards from a given log, it is necessary to turn the log periodically. I wasn't satisfied with how my exisiting log turner worked or with its location. The operator needs to be near the saw blade to see what he is doing. When logs are and turned at the other end of the sawmill, away from the operator's station, it is more difficult for the operator to determine if the logs are correctly turned. By coming up with a simple sawmill carriage log turner, the operator doesn't have to return the sawmill carriage to a separate log turning station, and then lose more time trying to properly turn the log, and then return the sawmill carriage to the sawblade. To avoid this waste of time, I invented a device to turn a log, said device can be fixed to and carried by a sawmill carriage. My device is such a time saving convenience in the operation of a sawmill, that I am sure that it was out there, it would be in widespread usage in sawmills throughout the country.

SUMMARY OF THE INVENTION

The present invention is a log turning device that mounts on and travels with a sawmill carriage. The device includes a log turning hook with positioning guide bar that is contained within and is slideable within a cylinder with guide, said cylinder with guide being pivotable with respect to the sawmill carriage. When clamp hooks, which are part of the sawmill carriage, release a log contained between the clamp hooks, the weight of the log against the log turning hook with positioning guide bar acts on the log turning hook with positioning guide bar in such a manner that the log rotates ninety degrees, while abutting the carriage so that the log is in position to be reclamped by the clamp hooks and held in position for the next saw cut.

DESCRIPTION OF THE PREFERRED EMBODIMENTS

Figure 1A:
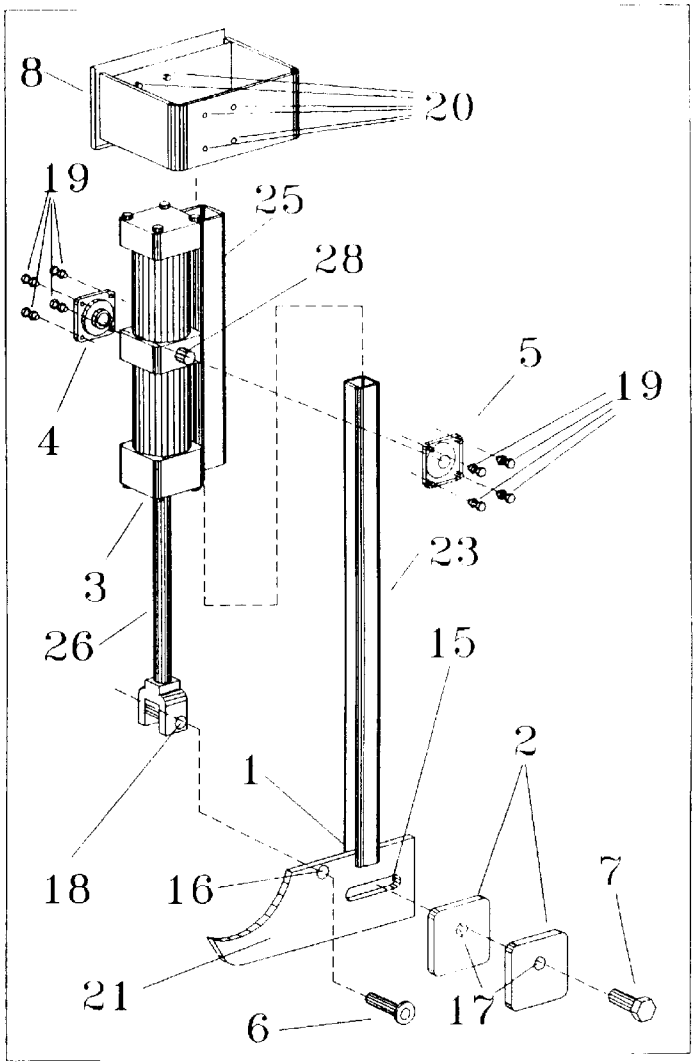
FIG. 1*a* is an exploded view of the present invention.
Figure 1:
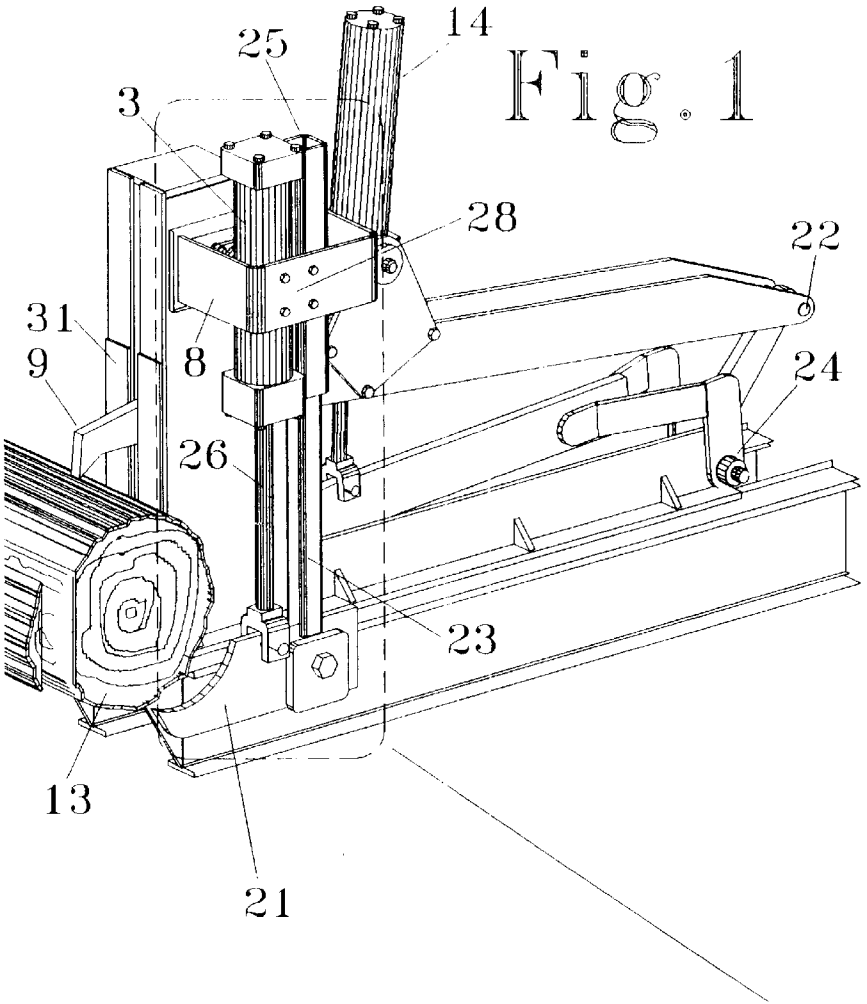
FIG. 1 shows a view of the present invention at rest while clamp hooks are holding a log securely within a sawmill carriage.
Figure 2:
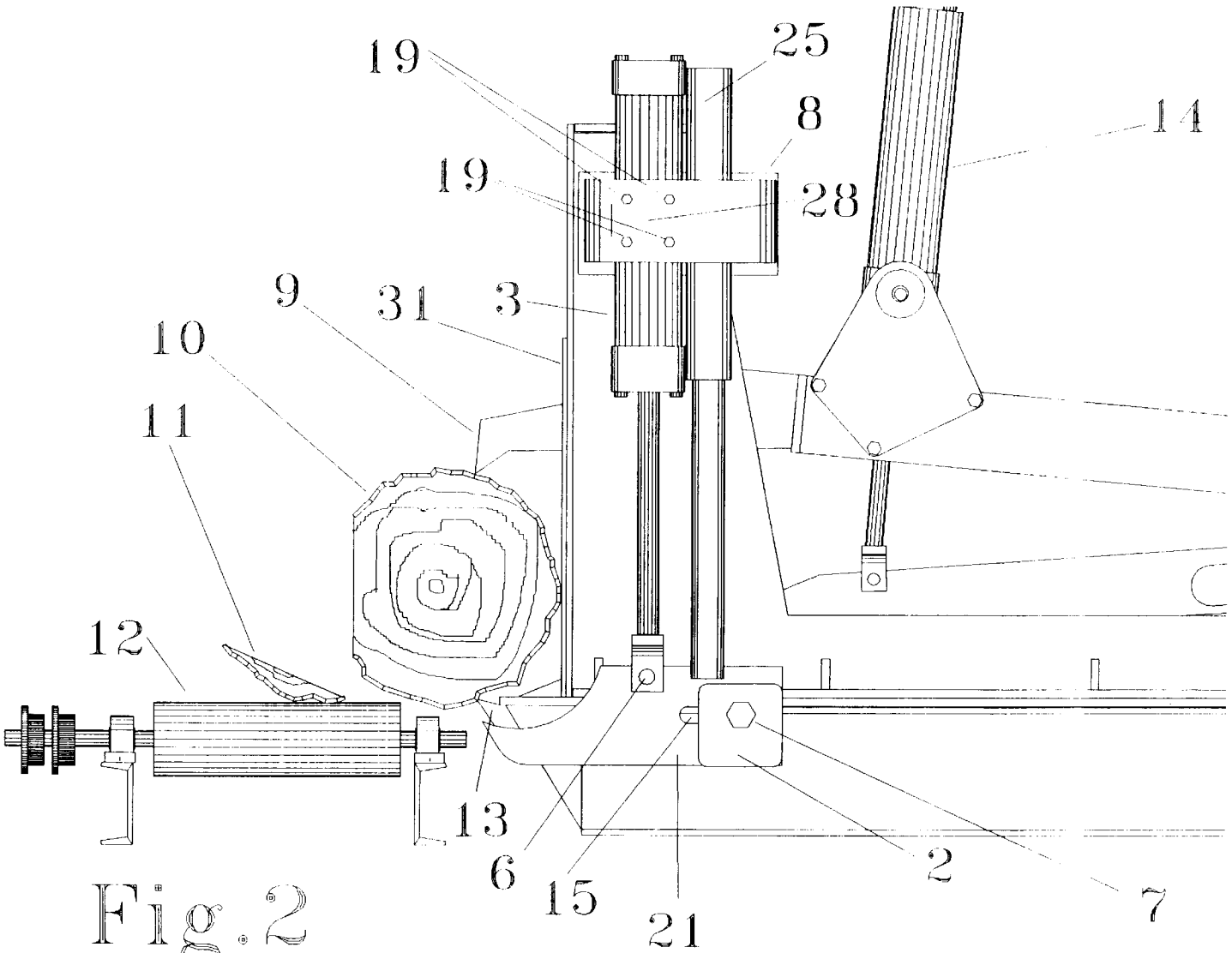
FIG. 2 shows a side view of the present invention at rest while the clamp hooks are holding a log securely within the sawmill carriage.

FIGS. 1 and 2 show the preferred embodiment of the present invention, a sawmill carriage log turner, installed on a typical sawmill carriage that will repeatedly carry a log through and then back past a sawblade. The carriage includes a forward, log-contacting face 5, an upper clamp hook 9, and a lower clamp hook 13, which are pivotable about their pivot axes 22, 24 by the cylinder 14. These pivot axes 22, 24 are substantially parallel to the axis of the log to be clamped by the hooks 9, 13. A log turning hook 21 is also mounted on the carriage. The log turning hook 21 is mounted on a piston rod 26, which projects from a cylinder 3. The cylinder 3 is pivotably mounted on a frame 8, which is fixed to the carriage, and the cylinder 3 pivots about a turning hook pivot axis 28, which is substantially parallel to the clamp axes 22, 24, and to the longitudinal axis of the log to be turned. A guide bar or support rod 23 is fixed to the log turning hook 21 parallel to the piston rod 26, and it is telescopically received in a guide sleeve or support sleeve 25, which is fixed to the outside of the cylinder 3 parallel to the piston rod 26, so that, as the piston rod 26 moves in and out of the cylinder 3, the guide bar 23 moves in and out of the guide sleeve 25 and is supported by the guide sleeve 25. FIG. 1*a* shows an exploded view of the preferred embodiment of the present invention, a sawmill carriage log turner 1, comprised of a log turning hook 21 with positioning guide bar 23, weights 2, a cylinder 3 with guide, a left side pivot mount 4, a right side pivot mount 5, an attachment pin 6, a mounting bolt 7, a frame 8, and bolts 19. The log turning hook with positioning guide bar 21 includes an aperture 16 and a slot 15. Each of the weights 2 includes a mounting bolt aperture 17. The cylinder with guide 3 includes an eye 18. The frame 8 includes bolt apertures 20. As can be seen in FIG. 1, the frame 8 supports the left side pivot mount 4 and the right side pivot mount 5 which contain and support the cylinder with guide 3. The cylinder with guide 3 pivots with respect to the frame 8 which contains the left side pivot mount 4 and the right side pivot mount 5 in a pendulum fashion, swinging freely about the pivot axis 28. As the frame 8 mounts to the sawmill carriage, this means the cylinder with guide 3 pivots with respect to the sawmill carriage. In the preferred embodiment of the present invention, the left side pivot mount 4 and the right side pivot mount 5 are hanger bearings. However, as obvious to anyone skilled in the state of the art, pivot mounts fabricated with bushings would work, albeit maybe not as well. The bolts 19 secure the left side pivot mount 4 and the right side pivot mount 5 to the frame 8. The log turning hook with positioning guide bar 21 is secured to the eye 18 of the cylinder with guide 3 by means of the attachment pin 6. The weights 2 are secured in the slot 15 by the mounting bolt 7 with a nut or a retaining ring or an equivalent, through the mounting bolt aperture 17 of the weights 2 and the slot 15 in the log turning hook with positioning guide bar 21. The purpose of the slot 15 is to permit position adjustment of the weights 2 so as to adjust the pendulum swing of the log turning hook with positioning guide bar 21. As the position of the weights 2 are adjusted, the center of gravity of the log turning hook with positioning guide bar 21 is changed, which in turn changes the resting position of the hook 21, which determines the point of contact of the the log turning hook with positioning guide bar 21 with a log 10. The resting position of the log turning hook 21 is such that the hook projects forward of the forward, log-contacting face 5, as shown in FIGS. 1 and 2. The log turning hook 21 with positioning guide bar 23 is contained within the cylinder with guide 3 in such a manner that the turning hook with positioning guide bar 21 can slide parallel with respect to the cylinder with guide 3. The cylinder with guide 3 pivots freely within the left side pivot 4 and the right side pivot 5 which fasten to the frame 8. By having the cylinder with guide 3 and the turning hook with positioning guide bar 21 able to pivot with respect to the frame 8 which affixes to the sawmill carriage, in a plane perpendicular to the log 10 contained in the sawmill carriage, as well as having the turning hook with positioning guide bar 21 able to slide parallel within the cylinder with guide 3, the preferred embodiment of the present invention, the sawmill carriage log turner 1 functions as shown in FIGS. 2, 3, 4, 5, and 6 and is explained further in this specification.

Figure 3:
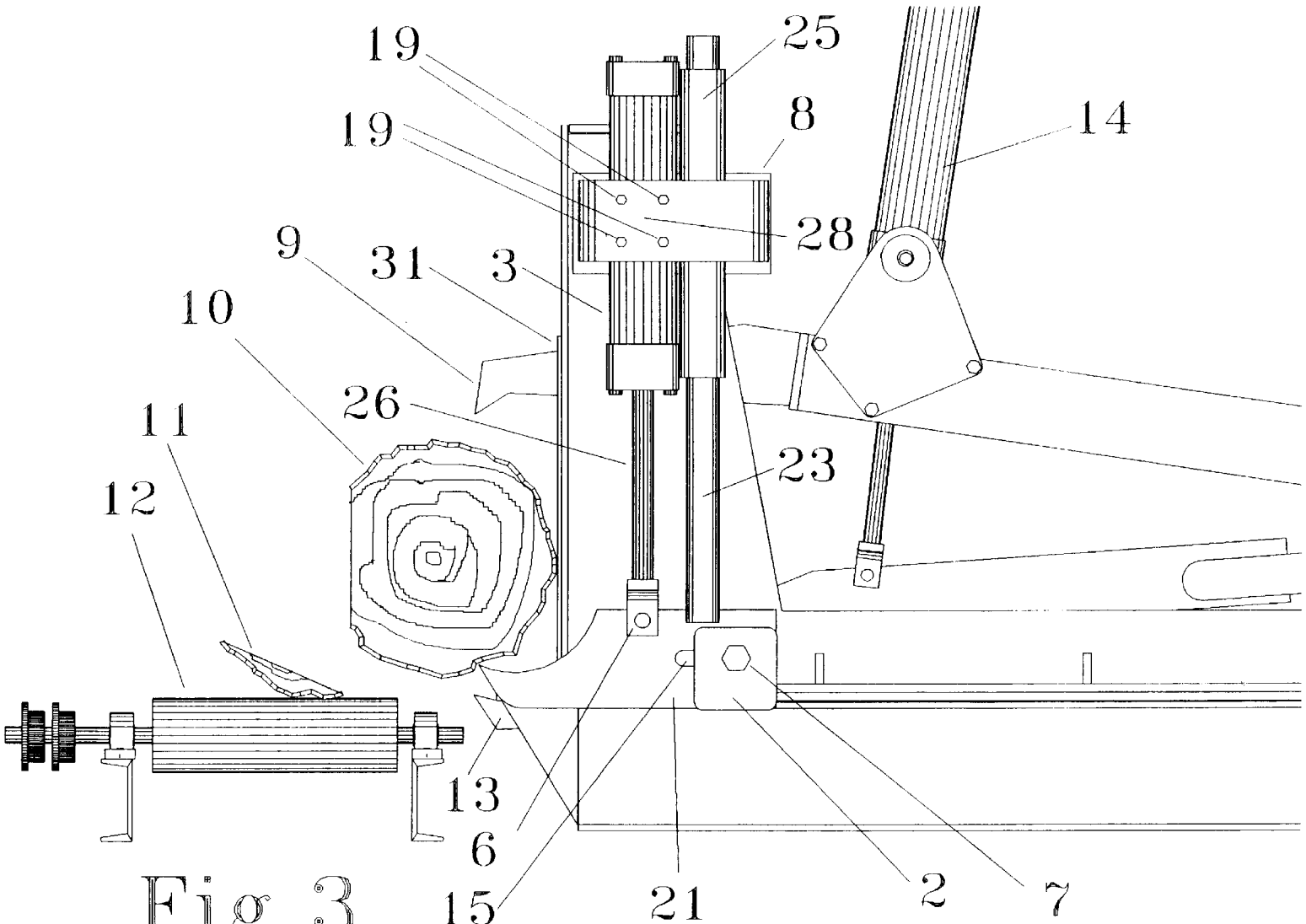
FIG. 3 shows the present invention just as the clamp hooks have released the log.
Figure 4:
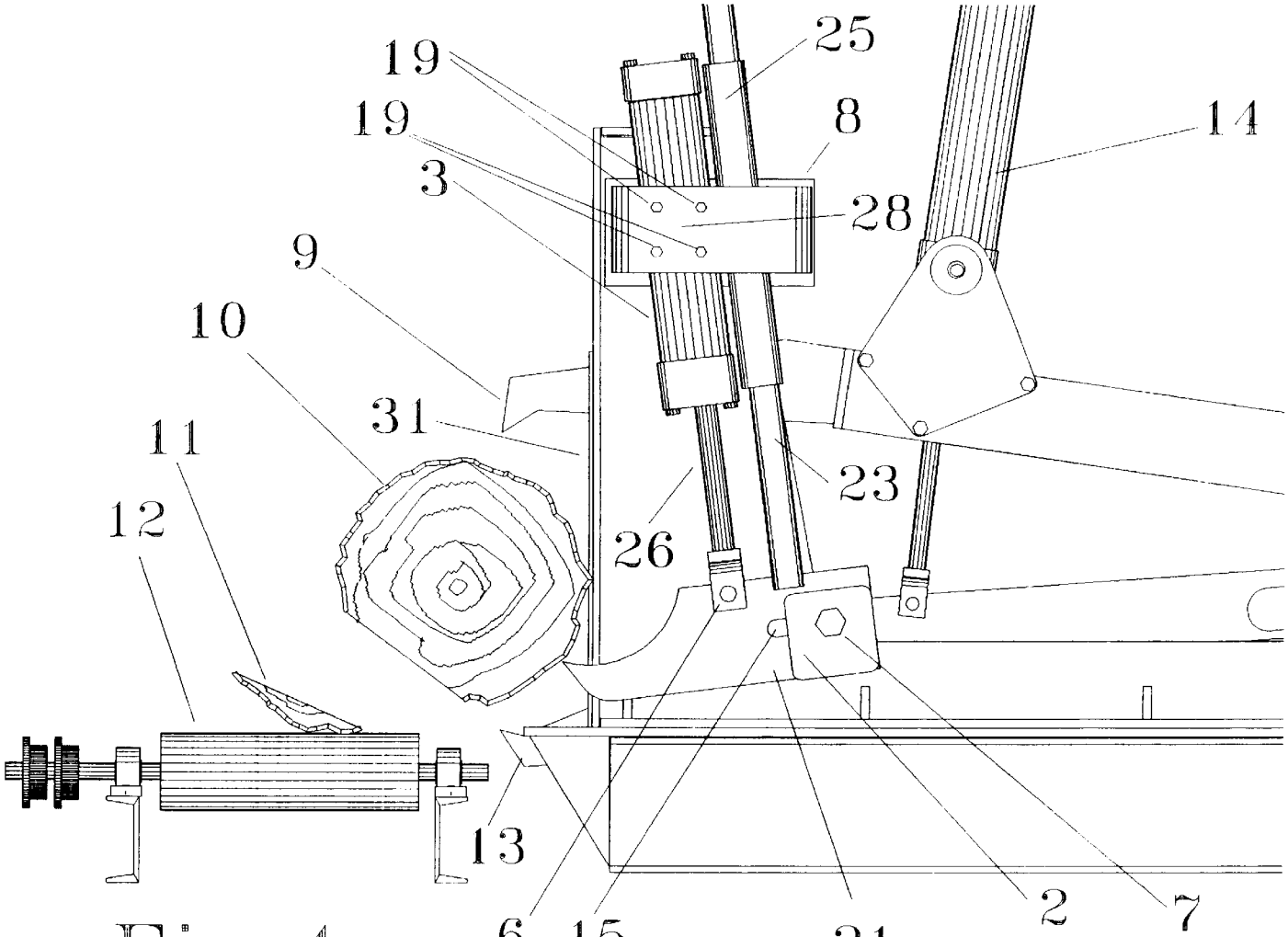
FIG. 4 shows the log rolling off a log turning hook with positioning guide bar into position for a desired cut.
Figure 5:
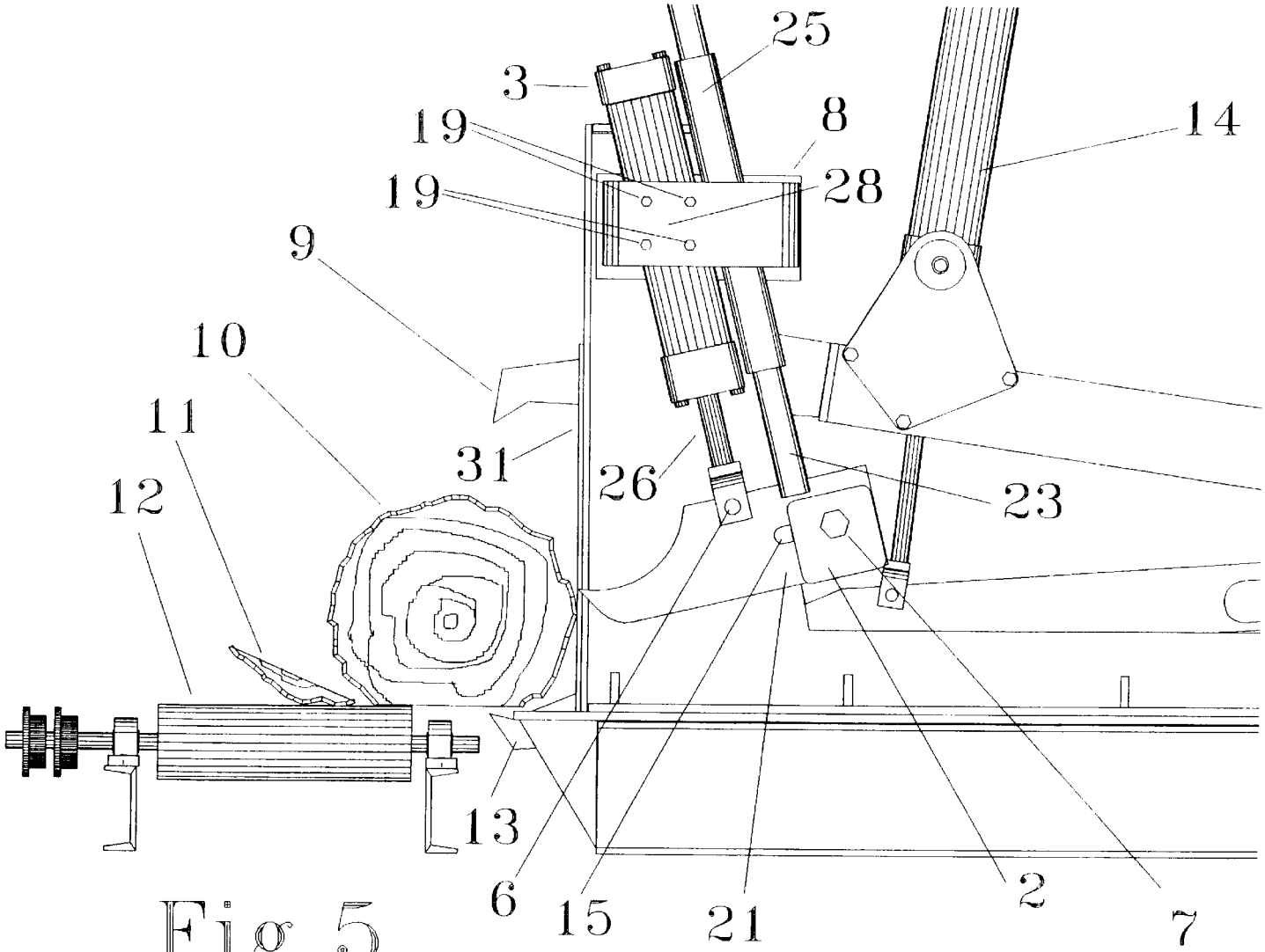
FIG. 5 shows the log turning hook with positioning guide bar free of the log just prior to the clamp hooks clamping the log.
Figure 6:
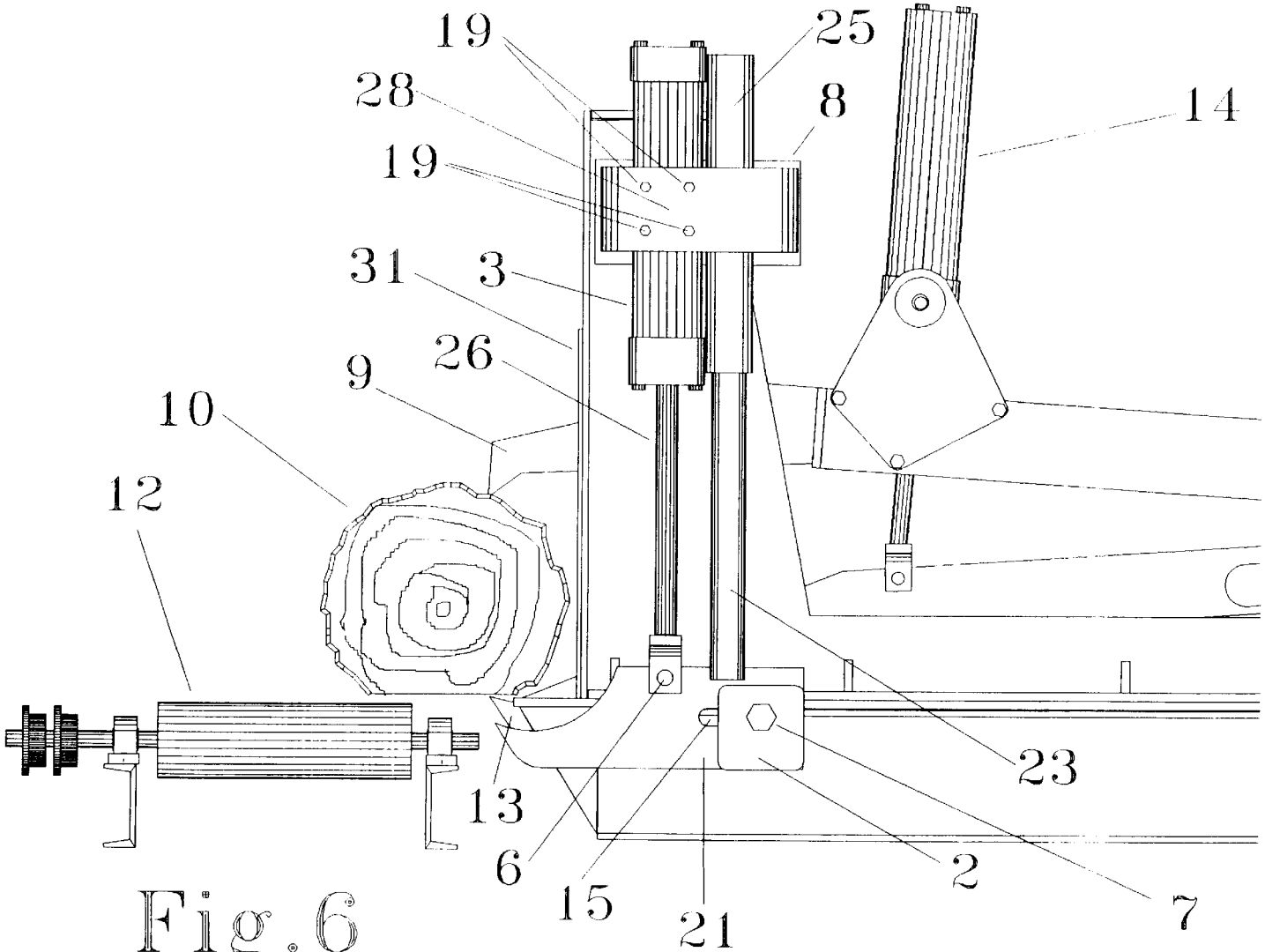
FIG. 6 shows the present invention with the log turning hook with positioning guide bar in the at rest position.

FIG. 2 shows the log 10 clamped between a top clamp 9 and a lower clamp 13, wherein the top clamp 9 and the lower clamp 13 are held in position by a clamp cylinder 14. The top clamp 9 may also be referred to as an upper clamp hook or as a first clamping hook. The lower clamp 13 may also be referred to as a lower clamp hook or as a second clamping hook. The clamp cylinder 14 may also be referred to as the cylinder. A scrap piece 11 has just been cut from the log 10, and has fallen on a conveyor belt 12, which will transport the scrap piece 11 to another station. When it is desired to turn the log 10, instead of returning the sawmill carriage with the log 10 to a turning station, as would be the case in prior art, the log can be turned with the preferred embodiment of the present invention, the sawmill carriage log turner 1. As shown in FIG. 3, the log turning hook with positioning guide bar 21, powered by the cylinder with guide 3, starts lifting the log 10 as the top clamp 9 and the lower clamp 13 release the log 10. The weight of the log 10 on the log turning hook with positioning guide bar 21, biases the log turning hook with positioning guide bar 21 in a counterclockwise direction as seen in FIG. 3, while holding the log 10 against the frame of the sawmill carriage as shown in FIGS. 3, 4, and 5. As the log turning hook with positioning guide bar 21 is biased in a counterclockwise direction, and as the piston rod 26 is retracted into the cylinder 3, as seen in FIGS. 3, 4, and 5, the log 10 is being rotated by the log turning hook with positioning guide bar 21. The log 10 falls into position as shown in FIG. 5. Then, as shown in FIG. 6, the top clamp 9 and the lower clamp 13 clamp the log 10 securely in position for the next cut, while the cylinder with guide 3 is extending, so the hook with positioning guide bar 21 is able to swing back into the at rest position, as shown in FIGS. 6, 1, and 2. The preferred materials of construction of my invention are steel. One inch steel plate worked well for the hook portion of the log turning hook with positioning guide bar 21. In the preferred embodiment of the present invention the cylinder with guide 3 includes an air actuated cylinder of sufficient diameter to pick up the weight of the log 10. As obvious to anyone skilled in the state of the art, a hydraulic cylinder could also serve the same purpose.

Although the description above contains many specificities, these should not be construed as limiting the scope of the invention but as merely providing illustrations of some of the presently preferred embodiments of this invention. For example, the attachment pin 6 could be a shoulder bolt. The means of securing the attachment pin 6 can be a cotter pin, or a nut, or a retainer ring, or safety wire, or the equivalent there of. The means of attaching the frame 8 to the sawmill carriage could a number of different ways. Some of the minor details, such as fastener specifics were not enumerated as being obvious to anyone skilled in the art so no excessive experimentation is required for the selection of bolts, nuts, or screws, or lockwashers or the installation there of. Thus the scope of the invention should be determined by the appended claims and their legal equivalents rather than by the examples given.

I claim:

1. A log carriage, having first and second clamping hooks mounted on the carriage for clamping a log to be sawed, each of said clamping hooks being pivotable about its respective pivot axis, the improvement comprising:

a log turner mounted on said carriage; said log turner including a cylinder pivotably mounted on said carriage so as to pivot about a turning hook pivot axis that is substantially parallel to the pivot axes of the clamping hooks; a piston rod projecting from said cylinder; and a third movable hook, mounted on said carriage so as to move with said piston rod, wherein, when a log is mounted on the carriage, and the clamping hooks are released from the log, the log will contact the third movable hook, which, as the piston rod is retracted, will pivot about the turning hook pivot axis, in order to cause the log to roll.

2. A log carriage, including a front, log-contacting face; and first and second clamp hooks projecting forward, beyond said front, log-contacting face, at least one of said clamp hooks movable relative to the other for gripping a log between the first and second clamp hooks; and a log turning hook mounted as a pendulum on said carriage so as to swing freely about a log turning hook pivot axis, wherein, in a resting position, said log turning hook extends forward of said front, log-contacting face.

3. A log carriage, as recited in claim 2, and further comprising a cylinder; and a piston rod projecting from said cylinder; wherein said log turning hook is mounted on said piston rod, and said cylinder is mounted on said carriage so as to pivot about said log turning hook pivot axis.

4. A log carriage, as recited in claim 3, and further comprising a weight mounted on said log turning hook, wherein the position of the weight relative to the log turning hook is adjustable for adjusting the resting position of the log turning hook.

5. A log carriage, as recited in claim 3, and further comprising a support rod mounted to said log turning hook parallel to said piston rod; and a support sleeve mounted to said frame in telescoping engagement with said support rod so as to support said support rod as the piston rod moves in and out of the cylinder.

* * * * *